US005485735A

United States Patent [19]

Laabs et al.

[11] Patent Number: 5,485,735

[45] Date of Patent: Jan. 23, 1996

[54] KEY OPERATED ROTARY PLUG AND CYLINDER LOCK

[75] Inventors: Timothy P. Laabs, Des Plaines; Michael O. Misner, Lake Villa; Richard H. Schulz, Palatine; Elbert M. Spencer, Wildwood, all of Ill.

[73] Assignee: The Eastern Company, Wheeling, Ill.

[21] Appl. No.: 163,149

[22] Filed: Dec. 6, 1993

[51] Int. Cl.[6] ..... E05B 27/06

[52] U.S. Cl. ..... 70/358; 70/406; 70/409; 70/419; 70/493

[58] Field of Search ..... 70/358, 493, 494, 70/409, 405, 406, DIG. 37, 337, 401, 419

[56] References Cited

U.S. PATENT DOCUMENTS

| | | | |
|---|---|---|---|
| 913,942 | 3/1909 | Bodge | 70/358 |
| 1,286,456 | 12/1918 | Vogelsang | 70/373 |
| 2,038,677 | 4/1936 | Recht et al. | 70/358 |
| 2,104,397 | 1/1938 | Hurd | 70/493 |
| 2,166,690 | 7/1939 | Neckerman | 70/358 |
| 2,733,590 | 2/1956 | Crumb | 70/358 |
| 3,303,677 | 2/1967 | Bauer | 70/358 |
| 3,349,587 | 10/1967 | Keller | 70/358 |
| 3,393,542 | 7/1968 | Crepinsek | 70/358 |
| 3,412,588 | 11/1968 | Schwegler | 70/358 |
| 3,413,831 | 12/1968 | Crepinsek | 70/358 |
| 3,512,382 | 5/1970 | Check et al. | 70/276 |
| 3,656,328 | 4/1972 | Hughes | 70/276 |
| 3,938,358 | 2/1976 | Doyle et al. | 70/358 |
| 3,974,670 | 8/1976 | Wolter | 70/421 X |
| 4,098,104 | 7/1978 | Wolter | 70/406 |
| 4,100,778 | 7/1978 | Gretler | 70/406 |
| 4,116,025 | 9/1978 | Wolter | 70/358 |
| 4,122,694 | 10/1978 | Gretler | 70/406 |
| 4,137,739 | 2/1979 | Keller | 70/358 |
| 4,343,166 | 8/1982 | Hofmann | 70/358 |
| 4,667,495 | 5/1987 | Girard et al. | 70/398 |
| 4,770,014 | 9/1988 | Knauer | 70/358 |
| 5,131,249 | 7/1992 | Baden et al. | 70/398 |

FOREIGN PATENT DOCUMENTS

| | | | |
|---|---|---|---|
| 0305336 | 3/1989 | European Pat. Off. | 70/358 |

*Primary Examiner*—Lloyd A. Gall
*Attorney, Agent, or Firm*—David A. Burge

[57] ABSTRACT

A key operated rotatable plug and cylinder define pin-receiving holes arranged in first, second and third rows that extend in first, second and third planes, respectively that radiate from a common center axis that extends substantially centrally through a plug-defined keyway. A key of generally rectangular cross-section is insertable into the keyway to bring recesses that are formed in its two relatively flat side surfaces and in one of its narrow edge surfaces into alignment with the pin-receiving holes so that inner ends of tumbler pins that are carried within the holes are received in the key-defined recesses to position the tumbler pins to permit plug rotation relative to the cylinder. The first plane extends from the center axis through the holes of the first row, and parallels the opposed, relatively flat side surfaces of a keyway-inserted key. The second and third planes extend from the center axis through the holes of the second and third rows, respectively, and position the second and third rows of pins so that they are inclined relative to the first plane at angles 1) that are unequal, 2) that do not cause the second and third planes to extend within a common plane, and 3) that are separately chosen from a set of values that reside between about seventy five and about one hundred five degrees, with values of ninety and one hundred five degrees being avoided in the selection of at least one, preferably both, of these angles.

49 Claims, 4 Drawing Sheets

KEY OPERATED ROTARY PLUG AND CYLINDER LOCK

BACKGROUND OF THE INVENTION

1. Field of the Invention

The present invention relates to a key operated rotatable plug and cylinder lock of the type that utilizes three sets of tumbler pins arranged in three rows extending in three planes that radiate from a common axis that extends centrally through a plug-defined keyway for engaging one row of recesses formed in a narrow edge surface, land two rows of recesses formed in opposed flat side surfaces of a substantially flat key. More particularly, the present invention relates to a rotatable plug and cylinder lock of the type described wherein one of the three planes extends from the center axis in a direction that parallels the opposed, relatively flat side surfaces of the key when the key is inserted into the keyway, while the two other planes extend from the center axis in non-aligned directions and at angles of inclination relative to the first plane that are unequal, with their angles of inclination being selected from a set of angles that reside within a range of about seventy five to about one hundred five degrees, with the angles that comprise each such set differing from each other by at least about five degrees, and with the inclination angles of ninety and one hundred five degrees being avoided in selecting at least one, preferably both, of these angles.

2. Prior Art

Rotatable plug and cylinder locks are known that employ three rows of tumbler pins arrayed about a central axis of a plug-defined keyway for engaging recesses that are formed in opposite side and edge surfaces of a flat key that can be reversibly inserted into the keyway. One of the rows of tumbler pins typically engages recesses formed in an edge surface of an inserted key, while each of the other rows engages recesses formed in a separate one of the opposed flat sides of the inserted key.

A traditional approach that has been taken in arranging three rows of tumbler pins to engage recesses formed in a substantially flat key has called for a first row of tumbler pins to extend in a first plane that is disposed between and parallels the opposed flat sides of an inserted key (so that the first set of tumbler pins engages recesses formed in a narrow edge surface of the inserted key) with second and third sets of tumbler pins extending in second and third planes, respectively, that extend from the central axis on opposite sides of the first plane, at equal angles of inclination relative to the first plane (whereby a "symmetrical" arrangement of tumbler pins is defined in that the second and third sets of tumbler pins extend at equal angles relative to the first plane and therefore can be said to be arranged symmetrically about the first plane).

Two "symmetrical" arrangements of three rows of tumbler pins have gained wide acceptance for use with flat keys. One widely accepted arrangement calls for second and third sets of tumbler pins to be inclined at right angles relative to a first edge-engaging set of tumbler pins, with the first, second and third sets extending in first, second and third planes, respectively, that intersect at right angles along a center axis that extends centrally through a plug-defined keyway. With this arrangement, the second and third sets of tumbler pins are "aligned" in the sense that they extend in opposite directions within a common plane. Recesses that are formed in opposite sides of a key to receive inner ends of the tumblers are not "oblong" (as is the case when the recesses are drilled at angles of inclination other than ninety degrees), but rather are distinctively circular— which enables one who is skilled in the art to ascertain the angular relationship of tumblers in a lock by gaining only a quick glance at a key that operates the lock. This "right angle" arrangement of second and third sets of tumbler pins relative to a first set has come to be referred to as a "90/90" arrangement, with each of the numerals "90" referring to angles of inclination of second and third rows of tumbler pins relative to a first row of tumbler pins that engages a flat edge surface of an inserted key.

A more secure, somewhat more difficult to defeat arrangement of three sets of tumbler pins that has come to be widely used with a flat key calls for second and third rows of tumbler pins to be equally inclined at angles of one hundred five degrees relative to a first row of edge-engaging tumbler pins. With this arrangement, recesses that are formed in opposite flat sides of a key for receiving inner ends of the second and third rows of tumblers are of "oblong" shape inasmuch as they are drilled at one hundred five degree angles relative to the flat side surfaces of the key. A problem with this symmetrical "105/105" arrangement of tumblers is that it has come to be sufficiently well known that it ordinarily is "assumed to exist" by those who are skilled in the art when they see the characteristically "oblong" shaped recesses that are formed in opposite flat sides of a key that is used to operate a lock of this type. As those who are skilled in the art of picking locks have come to be increasingly familiar with techniques that can be used to defeat locks that employ the relatively standard 105/105 symmetrical arrangement of tumbler pins, locks that embody this tumbler pin arrangement are progressively coming to be viewed as providing less that a desired degree of security.

The 90/90 and 105/105 symmetrical arrangements of tumbler pins have come to be so widely accepted for use with flat keys that key cutting machines now are available that are designed to form recesses in opposite sides of keys that either are inclined at ninety degrees or at one hundred five degrees. Thus, when it comes to producing keys that have recesses that will accommodate pins that extend toward flat side surfaces of an inserted key at angles of either ninety or one hundred five degrees, relatively little difficulty is encountered—a factor that also tends to diminish the degree of "security" that is perceived to be associated with locks that employ 90/90 and 105/105 symmetrical tumbler pin arrangements.

SUMMARY OF THE INVENTION

The present invention addresses the foregoing and other drawbacks and shortcomings of the prior art by providing a key operated rotatable plug and cylinder lock of the type that utilizes a non-symmetrical arrangement of three rows of tumbler pins that extend in planes that radiate from a common axis that extends centrally through a plug-defined keyway, with one row of tumblers being positioned to engage recesses formed in a narrow edge surface of an inserted flat key, and with the other two rows of tumblers being positioned to engage recesses formed in opposed side surfaces of an inserted flat key. While one of the three planes extends from the center axis in a direction that parallels the opposed, relatively flat side surfaces of a keyway-inserted key to position a first row of tumblers to engage recesses that are formed in a narrow edge surface of an inserted flat key (just as has come to be widely accepted), the other two planes (within which second and third sets of tumblers operate) extend from the center axis in non-aligned directions that provide a "non-standard," "non-symmetrical" array of tumbler pin inclinations that renders significantly more difficult the duplication of keys and the picking of locks.

One of a set of guidelines that governs the selection of angles of inclination for the second and third planes relative to the first plane in locks that embody the present invention calls for each of these inclination angles to be selected from within ranges of about seventy five to about one hundred five degrees, and for each to be chosen from a set of angles that differ from each other by at least about five degrees. This guideline is dictated by a discovery that resides at the heart of the present invention, namely that, within a range of inclination angles extending from about seventy five degrees to about one hundred five degrees, the use of unequal inclinations (of the second and third rows of tumbler pins relative to the first row) that differ by at least about five degrees easily can frustrate picking efforts and easily can significantly complicate key duplication efforts.

While selectable inclination angles (of the second and third rows of tumbler pins relative to the first row) may, if desired, be spaced apart within the range of seventy five to one hundred five degrees by more than five degrees (e.g., by defining ten degree increments that provide selectable inclination angles of 75, 85, 95 and 105 degrees) , five degree increments (that, for example, can provide selectable inclination angles of 75, 80, 85, 90, 95, 100 and 105 degrees, or an alternative set of angles such as 78, 83, 88, 93, 98 and 103 degrees) serve the intended purposes.

Another guideline that governs the inclinations of the second and third planes relative to the first plane in locks that embody the present invention calls for the second and third planes to be arranged such that they do not "align" so as to extend within a common plane. Inasmuch as it has been found that locks having three rows of tumblers tend to be more easily picked if two of the rows of tumblers are "aligned" (as by to extending in precisely opposite directions within a common plane for engaging opposite flat side surfaces of an inserted key), the present invention calls for "aligned" rows of tumbler pins to be avoided.

Another guideline that governs the inclinations of the second and third planes relative to the first plane in locks that embody the present invention calls for the second and third planes to be arranged so that they do not extend at equal angles of inclination relative to the first plane. Inasmuch as locks having second and third rows of tumbler pins that are inclined at equal angles relative to a first row of tumbler pins tend to be easier to pick (and their keys tend to be easier to form) than is the case with locks that have "non-symmetrical" arrangements of tumblers, the present invention calls for "symmetrical" tumbler arrangements to be avoided.

Still another guideline that governs the selection of inclination angles for the second and third planes calls for the commonly utilized inclination angles of ninety and one hundred five degrees to be avoided, at least in the selection of one, preferably both, of these inclination angles. By inclining at least one (preferably both) of the second and third planes at non-standard inclination angles of other than ninety and one hundred five degrees, the resulting locks are rendered more difficult to pick, and keys for such locks are rendered more difficult to produce.

A significant advantage provided by the present invention relates to the vastly enhanced number of available key configuration combinations that results when not only the lengths of tumblers but also the relative angles of inclination of tumbler rows can be selected to provide locks that each are operated by a differently configured key.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
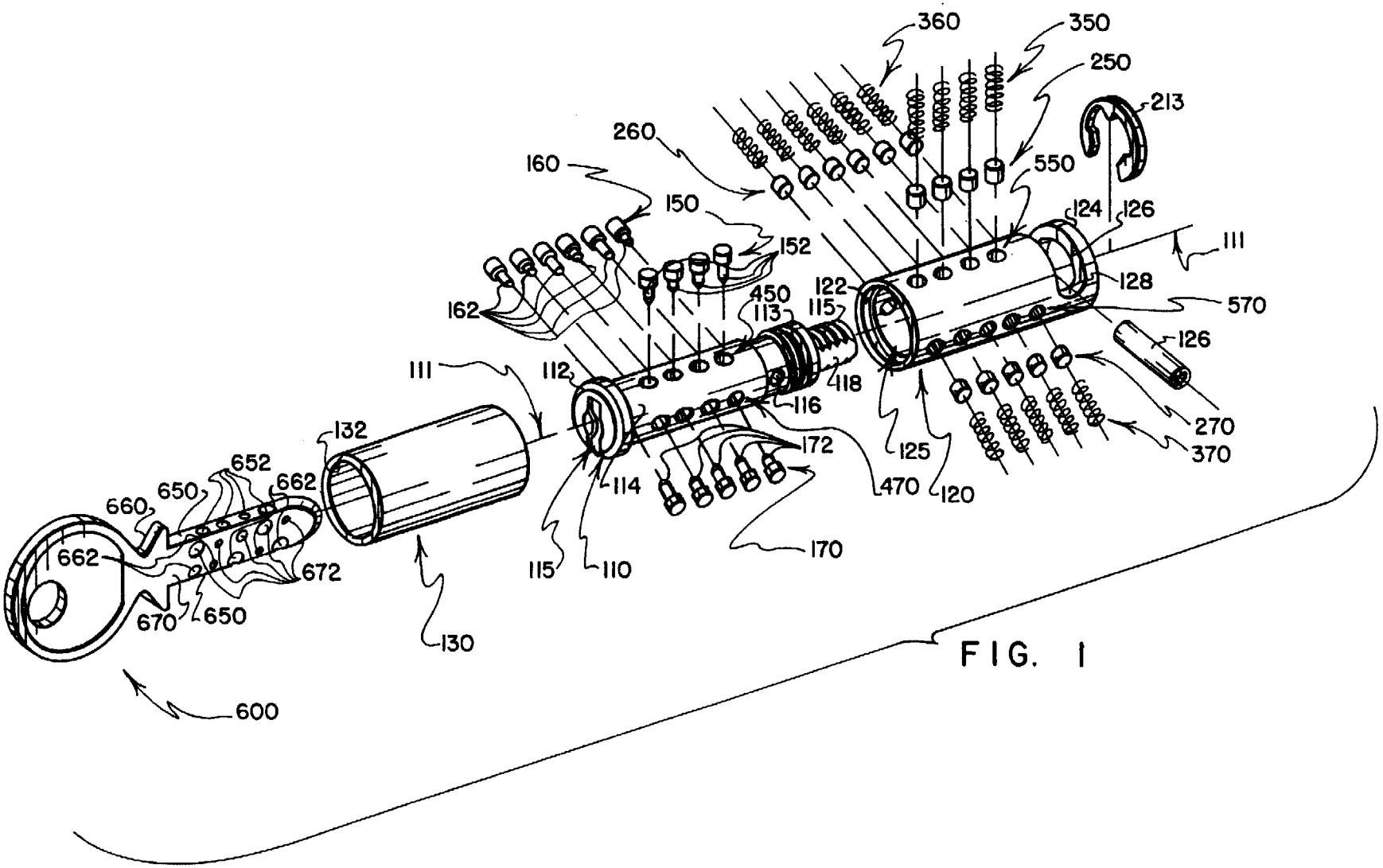
FIG. 1 is an exploded perspective view showing components of a key operated rotary plug and cylinder lock unit that embodies the best mode known for carrying out the preferred practice of the present invention.
Figure 2:
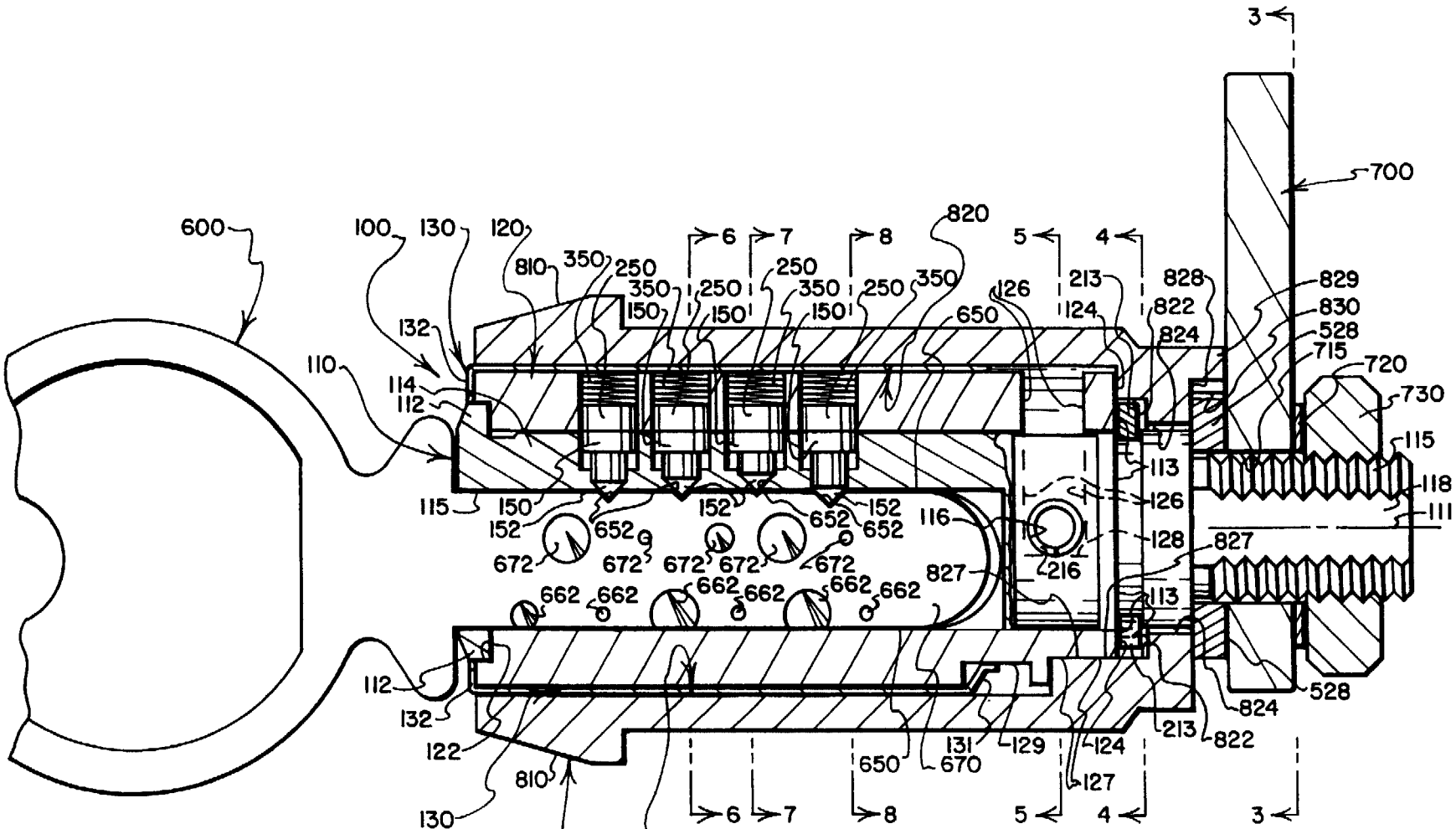
FIG. 2 is a cross-sectional view, on an enlarged scale, as seen from a vertical plane that extends substantially centrally through assembled components of the lock unit of FIG. 1, with the view also showing portions of other components that typically are used with the lock unit of FIG. 1 including a housing in which the assembled components of the lock unit are mounted, a cam that is operated by the lock, and a suitably configured key for operating the lock.

Referring to FIG. 1, a key operated rotary plug and cylinder lock embodying the preferred practice of the present invention is indicated generally by the numeral 100. The lock 100 includes a generally cylindrical plug 110 that defines a keyway 115 of generally rectangular cross section, and a generally cylindrical cylinder 120 that has a generally cylindrical plug-receiving passage 125 formed therethrough for receiving and journaling the plug 110 for smooth rotation therein, and a generally cylindrical thin metal retaining sleeve 130 for snugly surrounding the perimeter of tumbler-receiving portions of the cylinder 120. When assembled, as depicted in FIG. 2, the plug 110, the cylinder 120 and the sleeve 130 extend coaxially about a center axis 111 that extends centrally through the keyway 115.

Referring to FIGS. 1, 2, 9 and 10, three sets of tumbler bottom pins 150, 160, 170, three sets of tumbler driver pins 250, 260, 270, and three sets of springs 350, 360, 370 are provided for insertion into three sets of aligned holes 450, 550 (see FIG. 2), 460, 560 (see FIG. 9) and 470, 570 (see FIG. 10) that are formed in the plug and cylinder 110, 120, respectively. As is depicted variously in FIGS. 2, 9 and 10, inner end regions 152, 162, 172 of the bottom pins 150, 160, 170 are rounded and are extensible 1) into concave recesses 652 formed in an edge surface 650 of a "suitably configured" key 600 (see FIG. 2), 2) into concave recesses 662 formed in a flat side surface 660 of the key 600 (see FIG. 9), and 3) into concave recesses 672 formed in an opposed flat side surface 670 of the key 600 (see FIG. 10), respectively.

A "suitable configuration" of the key 600 that renders the key 600 capable of operating the lock 100 is attained by drilling the recesses 652, 662, 672 1) at proper locations along the key surfaces 650, 660, 650, respectively, 2) at proper angles of inclination relative to the surfaces 650, 660, 670, respectively, and 3) to proper depths—so that when the inner end regions 152, 162, 172 of the bottom tumblers 150, 160, 170 are duly received within the recesses 652, 662, 672, the lines of juncture between the bottom tumblers 150, 160, 170 and the their associated driver tumblers 250, 260, 270 align with the juncture between the plug 110 and the cylinder 120. This alignment (depicted variously in FIGS. 2 and 6–11) frees the plug 110 to rotate within the confines of the plug-receiving passage 125 relative to the cylinder 120 to selectively position an operating member such as a pawl 700 that is depicted in FIG. 2.

So that those who use the key 600 need not be concerned about inserting the key 600 "right side up" into the keyway 115, the key 600 is configured to be "reversible" in the sense that it is configured to operate the lock 100 regardless of which of its opposed edges 650 faces upwardly during insertion of the key 600 into the keyway 115. Thus, a set of the recesses 652 is provided in each of the narrow top and bottom edge surfaces 650 of the key 600, and both of the sets of recesses 662, 672 are provided in each of the flat side surfaces 660, 670 of the key 600.

Figure 3:
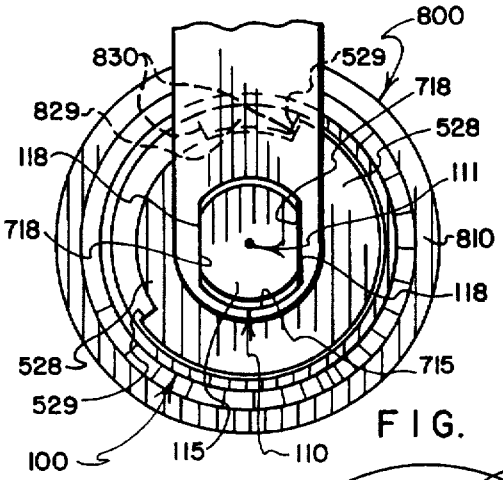
FIGS. 3, 4, 5, 6, 7 and 8 are cross-sectional views of the assembled lock components as seen from planes indicated by lines 3—3, 4—4, 5—5, 6—6, 7—7 and 8—8, respectively, in FIG. 2.

Referring to FIG. 1, the plug 110 has an enlarged diameter front end region 112, and a generally cylindrical body 114 that extends rearwardly from the enlarged diameter front end region 112 toward a diminished diameter rear end region that is threaded, as is indicated by the numeral 115. A pair of opposed flat surfaces 118 (one of which is depicted in FIG. 1, but both of which are depicted in FIG. 3) are formed on opposite sides of the threaded rear end region 115 for drivingly engaging correspondingly configured flat surfaces 718 that are defined on opposite sides of a hole 715 that is formed through the pawl 700 (see FIG. 3). When the pawl 700 is connected to the plug 110 by inserting the threaded end region 115 of the plug 110 through the hole 715 so that the flats 118, 718 drivingly engage, the pawl 700 is connected to the plug 110 for rotation therewith about the center axis 111. Referring to FIG. 2, a lock washer 720 and a nut 730 are installed on the threaded end region 115 for securing the pawl 700 in place on the end region 115 of the plug 110.

Figure 4:
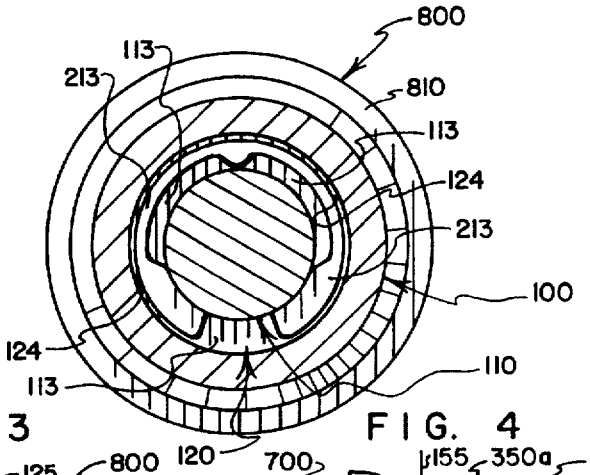

At a location that is spaced slightly forwardly from the rear end region 115 of the plug 110, a groove 113 (see FIGS. 1, 2 and 4) is formed in the plug 110 for receiving a spring steel retaining clip 213. At a still more forward location, a hole 116 (see FIGS. 1, 2 and 5) is formed through the body 114 for receiving a roll pin 216.

Referring to FIG. 2, the plug-receiving passage 125 that is formed in the cylinder 120 has an enlarged diameter front end region 122 that is configured to receive and surround the enlarged diameter front end region 112 of the plug 110. Extending rearwardly from the enlarged diameter front end region 122 to a rear face 124 of the cylinder 120, the passage 125 is of substantially uniform diameter—a diameter that is selected to receive the cylindrical body 114 of the plug 110 in a slip fit that will permit the plug 110 to rotate smoothly within the passage 125 of the cylinder 120.

As is best seen in FIG. 2, the location of the rear face 124 of the cylinder 120 is at the forward edge of the groove 113 that is formed in the plug 110. When the spring steel retaining clip 213 (see FIGS. 2 and 4) is inserted in the groove 113 so as to grip portions of the plug 110 to retain the position of the clip 213 on the plug 110, the outer diameter portions of the clip 213 project radially outwardly from the groove 113 for a sufficient distance to overlie portions of the rear face 124 of the cylinder 120—by which arrangement the plug 110 is retained within the cylinder 120 and is prevented from moving forwardly within the passage 125.

Figure 5:
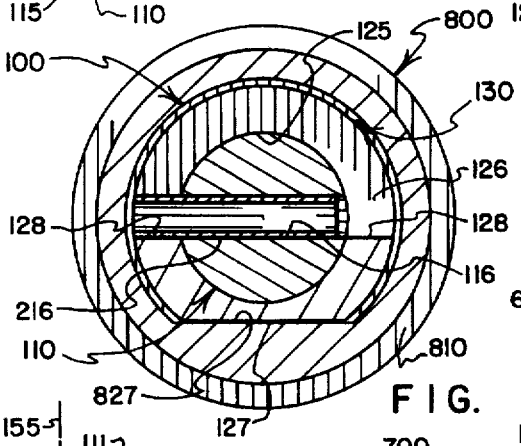

Referring to FIGS. 1, 2 and 5, a slot 126 is formed through the cylinder 120 and extends in a plane that is perpendicular to the center axis 111 (i.e., the plane that is indicated by the line 5—5 in FIG. 2). The slot 126 that is formed in the cylinder 120 aligns with the hole 116 that is formed in the plug 110 so that, when the roll pin 216 is pressed part way into the hole 116 (with one of its end regions left to project outwardly from the hole 116 and into the slot 126), the roll pin 216 cooperates with the cylinder 120 both to provide a secondary means of ensuring that the plug 110 cannot be forcibly removed from the cylinder 120, and to limit the range of angular movement through which the plug 110 can be rotated about the axis 111 relative to the cylinder 120.

While the slot 126 is depicted as being sufficiently lengthy to enable the plug 110 to rotate about the center axis 111 relative to the cylinder 120 through a permitted range of angular movement of about one hundred eighty degrees, the length of the slot 126 can be diminished or extended so that opposite ends of the slot 126 will interact with the roll pin 216 to more severely limit, or to less severely limit, the permitted range of angular movement of the plug 110 relative to the cylinder 120. For example, the permitted range of relative angular movement can be limited to a "quarter turn" by shortening the length of the slot 126.

Referring to FIGS. 2 and 3, another way in which the permitted range of angular movement of the plug 110 relative to the cylinder 120 can be diminished is by utilizing a cam member 528 that is configured to define a pair of stop surfaces 529 (one of which is shown in hidden lines in FIG. 3) that come into abutting engagement with opposed sides 830 of a stop formation 829 (shown in FIG. 2, and shown in hidden lines in FIG. 3). The stop formation 829 extends rearwardly from a rear end wall 828 of a housing 800 that surrounds the assembled plug, cylinder and sleeve unit 100.

By carefully positioning the stop surfaces 529, and by carefully configuring the stop formation 829 to define the stop surfaces 830, the range of angular movement of the plug 110 relative to the cylinder 120 (that is permitted by the interaction of the roll pin 216 with opposite ends of the slot 126) can be restricted as may be desired to configure the lock 100 for use in a particular application. For example, the stop surfaces 529 of the cam member 528 depicted in FIG. 3 cooperate with the housing-carried stop surfaces 830 to limit the permitted range of rotation of the plug 110 relative to the cylinder 120 to about ninety degrees (about a "quarter turn").

If it is not desired to restrict the range of permitted angular movement of the plug 110 relative to the cylinder 120 beyond the limited range of movement that is permitted by the interaction of the roll pin 216 with opposite ends of the slot 126, the member that is designated by the numeral 528 can simply comprise a flat washer that has no radially extending stop surfaces 529—whereby the only function served by the flat washer 528 is to space the pawl 700 rearwardly relative to the housing 800 so that, when the pawl 700 is rotated about the center axis 111, the pawl 700 does not inadvertently come into engagement with the rearwardly extending stop formation 829 of the housing 800. Other features of the housing 800 will be described shortly.

Referring to FIG. 2, two other features of the cylinder 120 remain to be described. One is a flat-bottom groove 127 or "flat" 127 that is defined within the vicinity of the juncture of the bottom side of the cylinder 120 with its rear end wall 124. The flat 127 is engaged by a formation 827 of the housing 800 to prevent rotation of the plug, cylinder and sleeve unit 100 relative to the housing 800—a feature that is best seen in FIGS. 2 and 5, the purpose for which will be described more completely later herein. The other feature is the provision of a small, closed-end hole 129 that is formed in the bottom side of the cylinder 120 at a location that is a short distance forward from the location of the flat 127—a feature that is best seen in FIG. 2, the purpose of which will be described shortly.

The sleeve 130 is a thin-walled tubular member that has a uniform inner and outer diameter along its full length, except at its forward end where an inwardly turned lip 132 is provided. While the inner diameter of the sleeve 130 is selected to permit the sleeve 130 to be slided onto the cylinder 120 to extend perimetrically about tumbler-carrying portions of the cylinder 120, the inner diameter is selected to provide a very snug fit about the cylinder 120 that will assist in retaining the sleeve 130 in place on the cylinder 120. As is best seen in FIG. 2, the lip 132 is turned inwardly only to a sufficient degree to ensure that it engages front rim portions of the cylinder 120 to prevent unwanted rearward movement of the sleeve 130 relative to the cylinder 120 after the sleeve 130 has been duly installed on the cylinder 120.

To assemble the components that are depicted in FIG. 1, the plug 110 is inserted into the plug-receiving passage 125 of the cylinder 120 so that the spring clip 213 and the roll pin 216 can be installed to prevent unwanted removal of the plug 110 from the cylinder 120. With corresponding sets of the pin-receiving holes 450 & 550, 460 & 560, and 470 & 570 aligned, corresponding sets of the tumbler pins 150 & 250, 160 & 260, and 170 & 270 are installed therein, as are the springs 350, 360, 370, whereafter the sleeve 130 is slided snugly into place in surrounding engagement with tumbler-carrying portions of the assembled plug and cylinder 110, 120. Referring to FIG. 2, a rear end portion 131 of the material of the sleeve 130 is staked into the closed bottom hole 129 provided on the underside of the cylinder 120 to secure the sleeve 130 in place on the cylinder 120.

Referring to FIG. 2, the cylinder and plug assembly 100 typically is installed in a generally cylindrical housing 800 that has an enlarged diameter bezel ring 810 near its front end, that defines a cylinder-receiving passage 820 that extends centrally through the generally cylindrical housing 800, and that defines the rear wall 828. The cylinder-receiving passage 820 is of substantially uniform diameter along its length except in the vicinity of its rear end region, where a sequence of two stepped-down diameters 822, 824 are defined, and where the previously mentioned "flat"827 is defined as extending forwardly from the region of the stepped down diameter 822 (best seen in FIG. 5). Referring to FIG. 2 and 5, the flat 827 extends into underlying juxtaposed relationship with the flat 127 that is defined by the cylinder 120. The interfitting relationship of the flats 127, 827 cooperate to prevent the cylinder 120 (and, thus the plug, cylinder and sleeve unit 100) from rotating within the cylinder-receiving passage 820.

Figure 6:
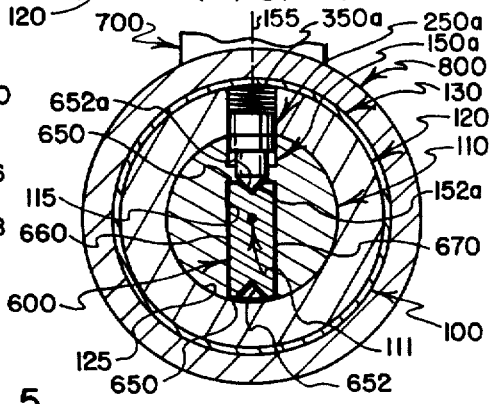
Figure 11:
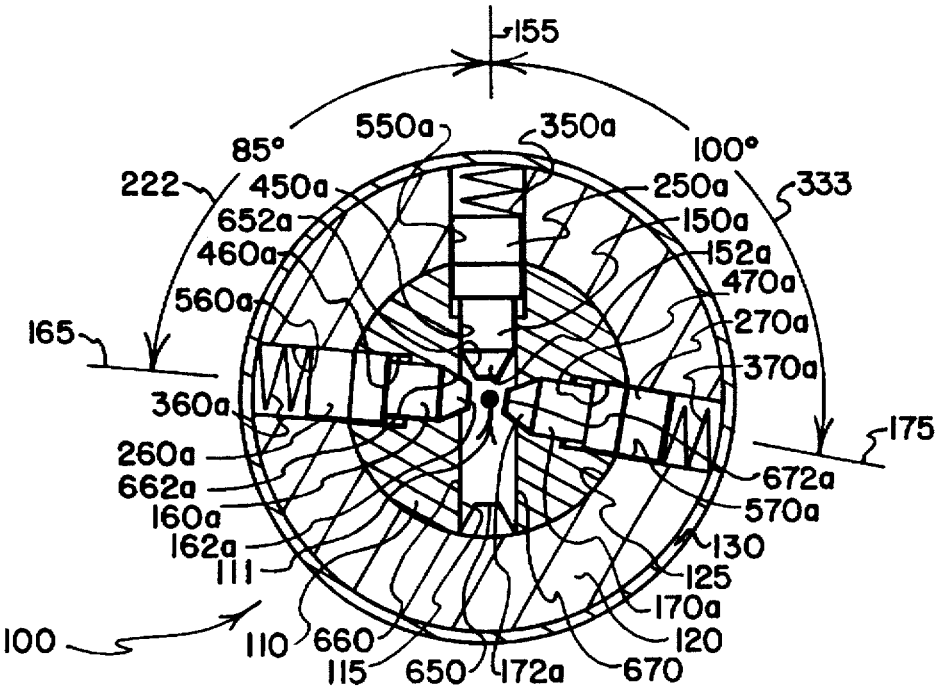
FIG. 11 is a schematic diagram that is provided to aid in explaining what is meant by "angles of inclination" between a first and second row of tumblers, and between a first and third row of tumblers, with the view depicting, substantially in cross-section, selected portions of the plug, cylinder and key, with each of the tumblers that are shown in FIGS. 5, 6 and 7 being depicted as if they were positioned within a common plane; and, FIG. 12 is a schematic diagram depicting two typical sets of inclination angles from which may be chosen the inclination angles that define how second the third sets of tumblers are to be oriented relative to a first set of tumblers.

Referring to FIGS. 2, 6 and 11, typical bottom and driver pins 150*a*, 250*a* from the first sets of bottom and driver pins 150, 250 are depicted as extending in a first plane 155 that projects vertically upwardly from the center axis 111 of the assembly 100. As will be noted, the first plane 155 substantially parallels opposed flat side surfaces of the key 600 when the key 600 is inserted into the keyway 115. A typical spring 350*a* is shown interposed between the interior surface of the sleeve 130 and the driver pin 250*a* for biasing the pins 150*a*, 250*a* inwardly toward the keyway 115.

Figure 7:
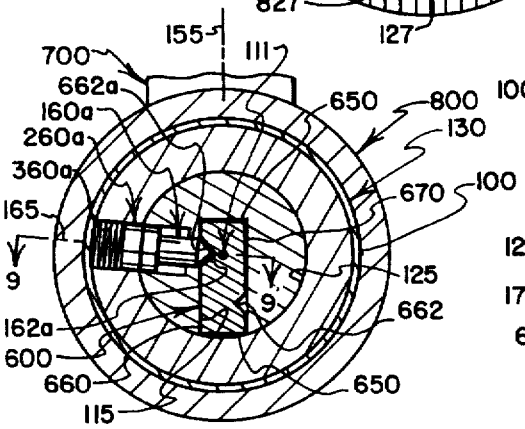
Figure 9:
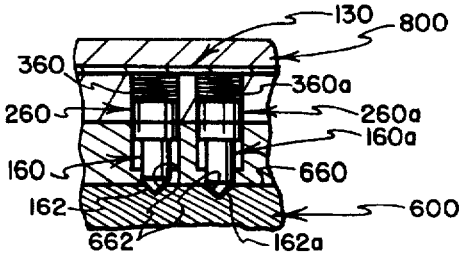
FIG. 9 is a sectional view of selected portions of the assembled lock components, as seen from a plane indicated by a line 9—9 in FIG. 7.

Referring to FIGS. 7, 9 and 11, typical bottom and driver pins 160*a*, 260*a* from the second sets of bottom and driver pins 160, 260 are depicted as extending in a second plane 165 that projects leftwardly and upwardly from the center axis 111 at a first angle of inclination relative to the first plane 155 that is identified by the numeral 222. As depicted in FIGS. 7 and 11, the angle 222 has been selected to equal eighty five degrees. A typical spring 360*a* is shown interposed between the interior surface of the sleeve 130 and the driver pin 260*a* for biasing the pins 160*a*, 260*a* inwardly toward the keyway 115.

Figure 8:
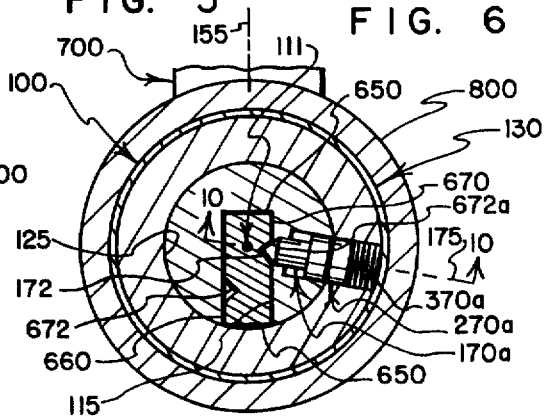
Figure 10:
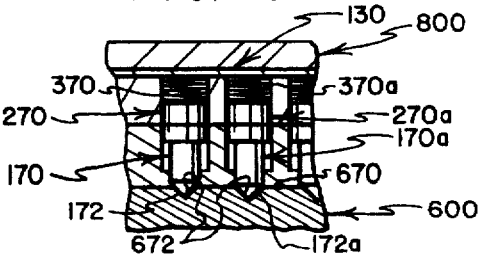
FIG. 10 is a sectional view of selected portions of the assembled lock components, as seen from a plane indicated by a line 10—10 in FIG. 8.

Referring to FIGS. 8, 10 and 11, typical bottom and driver pins 170*a*, 270*a* from the third sets of bottom and driver pins 170, 270 are shown depicted as extending in a third plane 175 that projects rightwardly and downwardly from the center axis 111 at a second angle of inclination relative to the first plane 155 that is identified by the numeral 333. As depicted in FIGS. 8 and 11, the angle 333 has been selected to equal one hundred degrees. A typical spring 370*a* is shown interposed between the interior surface of the sleeve 130 and the driver pin 270*a* for biasing the pins 170*a*, 270*a* inwardly toward the keyway 115.

Figure 12:
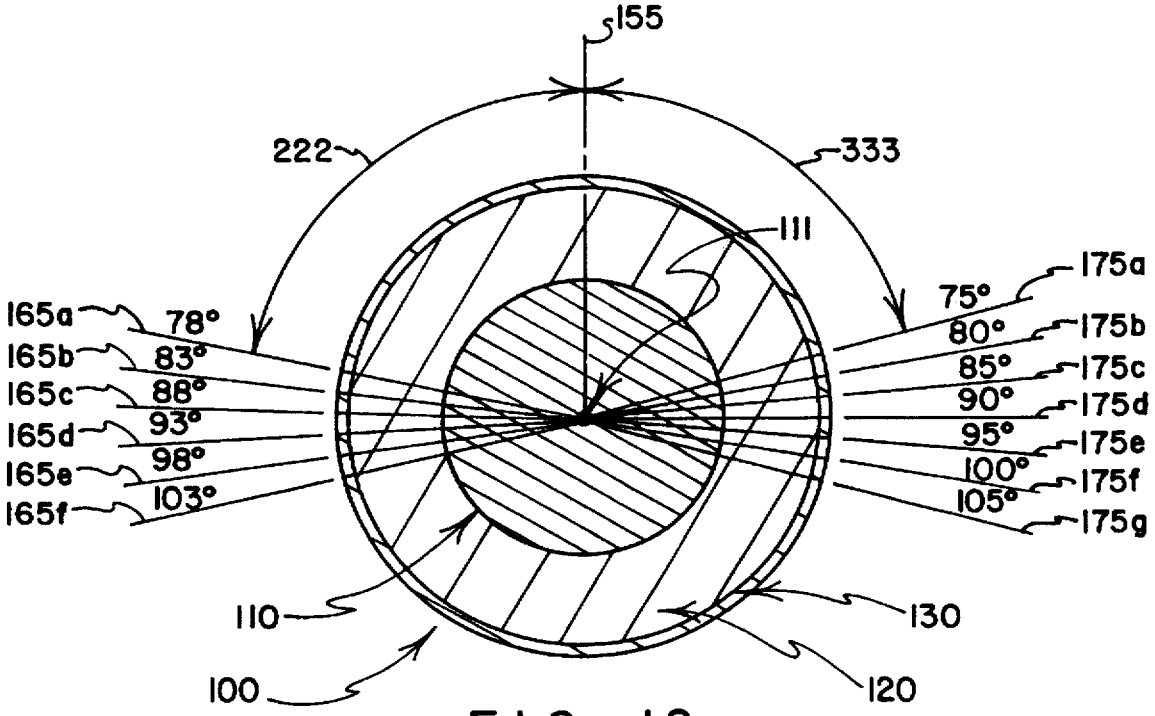

Referring finally to FIG. 12, toward the left side a set of six exemplary angles from which one might elect to select the inclination angle 222 are indicated by planes 165*a*, 165*b*, 165*c*, 165*d*, 165*e* and 165*f*, with these planes being inclined at angles of 78, 83, 88, 93, 98 and 103 degrees, respectively, relative to the plane 155. Toward the right side, a set of seven exemplary angles from which one might elect to select the inclination angle 333 are indicated by planes 175*a*, 175*b*, 175*c*, 175*d*, 175*e*, 175*f* and 175*g*, with these planes being inclined at angles of 75, 80, 85, 90, 95, 100 and 105 degrees, respectively, relative to the plane 155.

Many other sets of available inclination angles also are possible; however, in selecting such sets, the present invention calls for all values in each set to reside between about 75 and about 105 degrees, and for all values within each set to differ from each other by no less than about five degrees. A set can comprise one selected value (so long as it is between about 75 and about 105 degrees), or from two to seven selected values (so long as the values lie between about 75 and about 105 degrees, and so long as each of the values differs from the other by no less than about five degrees).

Once sets of values have been selected that are to be used for each of the inclination angles 222, 333, the present invention may call for some of the values within each of the sets to be discarded. For example, no values are to be selected for each of the angles 222, 333 that are substantially equal—for this would result in a substantially symmetrical arrangement of tumbler pins, and a symmetrical arrangement has been found to be easier to pick (and its keys easier to fabricate) than is desired when a high degree of security is to be ensured.

Likewise, no more than one of the inclination angles 222, 333 is to be selected to equal either 90 or 105 degrees, for these are commonly used orientation angles, and selecting more than one of the angles 222, 333 to equal 90 or 105 degrees is found to unduly diminish the degree of security that is afforded. In the most preferred practice of the present invention, the use of 90 and 105 degree values for either of the inclination angles 222, 333 is to be avoided, for any implementation that makes use of these commonly employed angles will not be acceptable in some high security applications.

Likewise, no angles of inclination 222, 333 are to be selected that position the planes 165, 175 so that they substantially align (i.e., so that they extend substantially within a common plane), for aligned plane embodiments also diminish resulting security to an unsatisfactory level.

To illustrate how these guidelines apply, consider an example wherein a decision has been taken to use a 5 degree spacing between possible values within both sets of angle values that can be selected for the angles 222, 333; and wherein the values that comprise each of the sets are to include 75, 80, 85, 90, 95, 100 and 105 degrees. For a first lock that is to embody this arrangement, let the angle 105 degrees be selected to comprise the inclination angle 222. For a second lock that is to embody this arrangement, let the angle 90 degrees be selected to comprise the inclination angle 222. For a third lock that is to embody this arrangement, let the angle 75 degrees be selected to comprise the inclination angle 222. What values then remain open from which the angles 333 can be chosen for each of the first, second and third locks?

For the first lock, since the angle 105 degrees was selected to comprise the angle 222, the angle 333 must not also equal 105 degrees, for that would provide both a symmetrical pin arrangement and a "double use" of one of the commonly encountered angles 90 and 105 degrees. The angle value 90 degrees also must be eliminated for use with the angle 333 for the "double use of common values" reason. The only other angle that would need to be eliminated from the remaining values of 75, 80, 85, 95 and 100 degrees is the angle 75 degrees, for use of a 105/75 set of angles will cause the planes 165, 175 to align so as to extend within a common plane.

For the second lock, since the angle 90 degrees was selected to comprise the angle 222, the angle 333 must not also equal 90 degrees, for that would provide not only a symmetrical pin arrangement and a "double use" of one of the commonly encountered angles 90 and 105 degrees, but also would result in the planes 165, 175 being aligned so as to extend within a common plane. The angle value 105 degrees also must be eliminated for use with the angle 333 for the "double use of common values" reason. Thus, the values that remain from which a selection can be made for the angle 333 include 75, 80, 85, 95 and 100 degrees.

For the third lock, since the angle 75 degrees was selected to comprise the angle 222, the angle 333 must not also equal 105 degrees, for that would cause the planes 165, 175 to align so as to extend within a common plane. The angle value 75 degrees also must be eliminated for use with the angle 333, for a 75/75 set of values for the angles 222, 333 would result in a symmetrical pin arrangement. Thus, the values that remain from which a selection can be made for the angle 333 include 80, 85, 90, 95 and 100 degrees.

While such terms as "horizontally extending," "front," "rear," "forwardly facing," "rearwardly facing," "left," "right" and the like are utilized herein, it will be understood that such terms are used merely to aid the reader in referring to features in the orientations in which they are depicted in the accompanying drawings, and are not to be construed as limiting the scope of the claims that follow.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty as exist in the invention.

What is claimed is:

1. A key operated plug and cylinder lock comprising:

a) a cylinder having a plug-receiving hole formed therein;

b) a generally cylindrical plug configured to be journaled for smooth rotation within the plug-receiving hole of the cylinder, and defining a keyway of substantially rectangular cross-section that extends along a center axis of the plug;

c) pin-receiving holes formed in the cylinder and in the plug, and arranged in first, second and third rows that extend in first, second and third planes, with all of the pin-receiving holes of the first row extending in the first plane, with all of the pin-receiving holes of the second row extending in the second plane, with all of the pin-receiving holes of the third row extending in the third plane, and with all of the pin-receiving holes extending perpendicular to and intersecting the center axis of the plug;

d) tumbler pins carried within the pin-receiving holes, with the tumbler pins having inner end regions that are extensible into the keyway, and outer end regions that can be positioned to bridge junctures of the plug and the cylinder to prevent relative rotation of the plug and the cylinder, and that can be positioned to align with junctures of the plug and the cylinder to permit relative rotation of the plug and cylinder;

e) an elongate key of generally rectangular cross-section configured to be smoothly insertable into the keyway to bring recesses that are formed in two relatively flat, opposed side surfaces of the key, and in one narrow edge surface of the key into alignment with the pin-receiving holes so that the inner end regions of tumbler pins may be received within the recesses to position the tumbler pins to align with junctures of the plug and the cylinder to permit relative rotation of the plug and cylinder, with the recesses that are formed in at least one of the side surfaces of the key all being of generally oblong shape;

f) with the first plane extending from the center axis coaxially through the first row of pin-receiving holes, and paralleling the opposed, relatively flat side surfaces of the key when the key is inserted into the keyway, whereby the first row of tumbler pins is positioned to engage recesses that are formed in the narrow edge surface of the key; and, g) with the second and third planes extending in a non-aligned, non-coplanar manner from the center axis coaxially through the second and third rows of pin-receiving holes, respectively, with the second and third planes being inclined relative to the first plane at unequal first and second angles of inclination, respectively, with the first angle being chosen from a first set of angles that reside within a range of about 75 to about 105 degrees, with the second angle being chosen from a second set of angles that reside with a range of about 75 to about 105 degrees, with the angles that comprise the first set differing from each other by no less than about 5 degrees, with the angles that comprise the second set differing from each other by no less than about 5 degrees, and with at least one of the chosen first and second angles of inclination not being equal to either of 90 and 105 degrees.

2. The lock of claim 1 wherein the angles that comprise at least one of the first and second sets include about 75, about 80, about 85, about 90, about 95, about 100 and about 105 degrees.

3. The lock of claim 1 wherein the angles that comprise at least one of the first and second sets include about 78, about 83, about 88, about 93, about 98 and about 103 degrees.

4. The lock of claim 1 wherein the angles that comprise at least one of the first and second sets includes angles that differ from each other by no less than about 10 degrees.

5. The lock of claim 4 wherein the angles that comprise said at least one of the first and second sets include about 80, about 90 and about 100 degrees.

6. The lock of claim 4 wherein the angles that comprise said at least one of the first and second sets include about 83, about 93 and about 103 degrees.

7. The lock of claim 4 wherein the angles that comprise said at least one of the first and second sets include about 75, about 85, about 95 and about 105 degrees.

8. The lock of claim 4 wherein the angles that comprise said at least one of the first and second sets include about 78, about 88 and about 98 degrees.

9. The lock of claim 1 wherein the angles that comprise the first set of angles include about 75, about 80, about 85, about 90, about 95, about 100 and about 105 degrees, and the angles that comprise the second set of angles include about 75, about 80, about 85, about 90, about 95, about 100 and about 105 degrees.

10. The lock of claim 1 wherein the angles that comprise the first set of angles include about 78, about 83, about 88, about 93, about 98 and about 103 degrees, and the angles that comprise the second set of angles include about 75, about 80, about 85, about 90, about 95, about 100 and about 105 degrees.

11. The lock of claim 1 wherein the first angle of inclination is selected to be about 75 degrees, and the second angle of inclination is selected from a set of angles that includes about 80, about 85, about 90, about 95, about 100 and about 105 degrees.

12. The lock of claim 1 wherein the first angle of inclination is selected to be about λdegrees, and the second angle of inclination is selected from a set of angles that includes about 75, about 85, about 90, about 95, about 100 and about 105 degrees.

13. The lock of claim 1 wherein the first angle of inclination is selected to be about 85 degrees, and the second angle of inclination is selected from a set of angles that includes about 75, about 80, about 90, about 95, about 100 and about 105 degrees.

14. The lock of claim 1 wherein the first angle of inclination is selected to be about 90 degrees, and the second angle of inclination is selected from a set of angles that includes about 75, about 80, about 85, about 95, about 100 and about 105 degrees.

15. The lock of claim 1 wherein the first angle of inclination is selected to be about 95 degrees, and the second angle of inclination is selected from a set of angles that includes about 75, about 80, about 85, about 90, about 100 and about 105 degrees.

16. The lock of claim 1 wherein the first angle of inclination is selected to be about 100 degrees, and the second angle of inclination is selected from a set of angles that includes about 75, about 80, about 85, about 90, about 95 and about 105 degrees.

17. The lock of claim 1 wherein the first angle of inclination is selected to be about 105 degrees, and the second angle of inclination is selected from a set of angles that includes about 75, about 80, about 85, about 90, about 95 and about 100 degrees.

18. The lock of claim 1 wherein neither of the first and second angles of inclination is equal to 90 degrees, and wherein neither of the first and second angles of inclination is equal to 105 degrees.

19. The lock of claim 1 wherein all of the recesses formed in both of the side surfaces of the key are of generally oblong shape.

20. A method of forming a set of substantially identical high security locks of the rotatable plug and cylinder type, wherein each of the locks of the set is formed in accordance with the steps of:

a) providing a cylinder having a plug-receiving hole formed therein;

b) providing a generally cylindrical plug configured to be journaled for smooth rotation within the plug-receiving hole of the cylinder, and defining a keyway of substantially rectangular cross-section that extends along a center axis of the plug;

c) forming pin-receiving holes in the cylinder and in the plug, with the pin-receiving holes being arranged in first, second and third rows that extend in first second and third planes, with all of the pin-receiving holes of the first row extending in the first plane, with all of the pin-receiving holes of the second row extending in the second plane, with all of the pin-receiving holes of the third row extending in the third plane, and with all of the pin-receiving holes extending perpendicular to and intersecting the center axis of the plug;

d) providing and inserting into the pin-receiving holes tumbler pins that have inner end regions that are extensible into the keyway, and outer end regions that can be positioned to bridge junctures of the plug and the cylinder to prevent relative rotation of the plug and the cylinder, and that can be positioned to align with junctures of the plug and the cylinder to permit relative rotation of the plug and cylinder;

e) providing an elongate key of generally rectangular cross-section configured to be smoothly insertable into the keyway to bring recesses that are formed in two relatively flat, opposed side surfaces of the key, and in one narrow edge surface of the key into alignment with the pin-receiving holes so that the inner end regions of tumbler pins may be received within the recesses to position the tumbler pins to align with junctures of the plug and the cylinder to permit relative rotation of the plug and cylinder, with the recesses that are formed in at least one of the side surfaces of the key all being of generally oblong shape;

f) with the step of forming pin-receiving holes in the cylinder and in the plug being carried out such that the first plane extends from the center axis coaxially through the first row of pin-receiving holes, and parallels the opposed, relatively flat side surfaces of the key when the key i s inserted into the keyway, whereby the first row of tumbler pins is positioned to engage recesses that are formed in the narrow edge surface of the key; and, g) with the step of forming pin-receiving holes in the cylinder and in the plug further being carried out such that the second and third planes extend in a non-aligned, non-coplanar manner from the center axis coaxially through the second and third rows of pin-receiving holes, respectively, with the second and third planes being inclined relative to the first plane at unequal first and second angles of inclination, respectively, with the first angle being chosen from a first set of angles that reside within a range of about 75 to about 105 degrees, with the second angle being chosen from a second set of angles that reside with a range of about 75 to about 105 degrees, with the angles that comprise the first set differing from each other by no less than about 5 degrees, with the angles that comprise the second set differing from each other by no less than about 5 degrees, and with at least one of the chosen first and second angles of inclination not being equal to either of 90 and 105 degrees.

21. A single lock formed in accordance with the method of claim 20 for use with a set of locks that also have been formed in accordance with said method.

22. A set of locks comprising at least one plug and cylinder lock formed in accordance with the method of claim 20.

23. A set of locks comprising a plurality of plug and cylinder locks formed in accordance with the method of claim 20.

24. A method of forming a set of substantially identical high security locks of the rotatable plug and cylinder type that each are operated by a separate key, with none of the locks of the set being operated by a key that operates another of the locks, wherein each of the locks of the set is formed in accordance with the steps of:

a) providing a cylinder having a plug-receiving hole formed therein;

b) providing a generally cylindrical plug configured to be journaled for smooth rotation within the plug-receiving hole of the cylinder, and defining a keyway of substantially rectangular cross-section that extends along a center axis of the plug;

c) forming pin-receiving holes in the cylinder and in the plug, with the pin-receiving holes being arranged in first, second and third rows that extend in first, second and third planes, with all of the pin-receiving holes of the first row extending in the first plane, with all of the pin-receiving holes of the second row extending in the second plane, with all of the pin-receiving holes of the third row extending in the third plane, and with all of the pin-receiving holes extending perpendicular to and intersecting the center axis of the plug;

d) providing and inserting into the pin-receiving holes tumbler pins that have inner end regions that are extensible into the keyway, and outer end regions that can be positioned to bridge junctures of the plug and the cylinder to prevent relative rotation of the plug and the cylinder, and that can be positioned to align with junctures of the plug and the cylinder to permit relative rotation of the plug and cylinder;

e) providing an elongate key of generally rectangular cross-section configured to be smoothly insertable into the keyway to bring recesses that are formed in two relatively flat, opposed side surfaces of the key, and in one narrow edge surface of the key into alignment with the pin-receiving holes so that the inner end regions of tumbler pins may be received within the recesses to position the tumbler pins to align with junctures of the plug and the cylinder to permit relative rotation of the plug and cylinder, with the recesses that are formed in at least one of the side surfaces of the key all being of generally oblong shape;

f) with the step of forming pin-receiving holes in the cylinder and in the plug being carried out such that the first plane extends from the center axis coaxially through the first row of pin-receiving holes, and parallels the opposed, relatively flat side surfaces of the key when the key is inserted into the keyway, whereby the first row of tumbler pins is positioned to engage recesses that are formed in the narrow edge surface of the key;

g) with the step of forming pin-receiving holes in the cylinder and in the plug further being carried out such that the second and third planes extend in a non-aligned, non-coplanar manner from the center axis coaxially through the second and third rows of pin-receiving holes, respectively, with the second and third planes being inclined relative to the first plane at unequal first and second angles of inclination, respectively, with the first angle being chosen from a first set of angles that reside within a range of about 75 to about 105 degrees, with the second angle being chosen from a second set of angles that reside with a range of about 75 to about 105 degrees, with the angles that comprise the first set differing from each other by no less than about 5 degrees, with the angles that comprise the second set differing from each other by no less than about 5 degrees, and with at least one of the chosen first and second angles of inclination not being equal to either of 90 and 105 degrees; and, h) with the step of providing and inserting tumbler pins into the pin-receiving holes including the step of providing at each of the locks of the set with a different-length set of tumbler pins, with the differences in lengths of the tumbler pins used in each of the locks being sufficient to ensure that the wrong key will not operate the wrong lock.

25. A single lock formed in accordance with the method of claim 24 for use with a set of locks that also have been formed in accordance with said method.

26. A set of locks comprising at least one plug and cylinder lock formed in accordance with the method of claim 24.

27. A set of locks comprising a plurality of plug and cylinder locks formed in accordance with the method of claim 24.

28. A method of forming a set of substantially identical high security locks of the rotatable plug and cylinder type that each are operated by a separate key, with none of the locks of the set being operated by a key that operates another of the locks, wherein each of the locks of the set is formed in accordance with the steps of:

a) providing a cylinder having a plug-receiving hole formed therein;

b) providing a generally cylindrical plug configured to be journaled for smooth rotation within the plug-receiving hole of the cylinder, and defining a keyway of substantially rectangular cross-section that extends along a center axis of the plug;

c) forming pin-receiving holes in the cylinder and in the plug, with the pin-receiving holes being arranged in first, second and third rows that extend in first, second and third planes, with all of the pin-receiving holes of the first row extending in the first plane, with all of the pin-receiving holes of the second row extending in the second plane, with all of the pin-receiving holes of the third row extending in the third plane, and with all of the pin-receiving holes extending perpendicular to and intersecting the center axis of the plug;

d) providing and inserting into the pin-receiving holes tumbler pins that have inner end regions that are extensible into the keyway, and outer end regions that can be positioned to bridge junctures of the plug and the cylinder to prevent relative rotation of the plug and the cylinder, and that can be positioned to align with junctures of the plug and the cylinder to permit relative rotation of the plug and cylinder;

e) providing an elongate key of generally rectangular cross-section configured to be smoothly insertable into the keyway to bring recesses that are formed in two relatively flat, opposed side surfaces of the key, and in one narrow edge surface of the key into alignment with the pin-receiving holes so that the inner end regions of tumbler pins may be received within the recesses to position the tumbler pins to align with junctures of the plug and the cylinder to permit relative rotation of the plug and cylinder, with the recesses that are formed in at least one of the side surfaces of the key all being of generally oblong shape;

f) with the step of forming pin-receiving holes in the cylinder and in the plug being carried out such that the first plane extends from the center axis coaxially through the first row of pin-receiving holes, and parallels the opposed, relatively flat side surfaces of the key when the key is inserted into the keyway, whereby the first row of tumbler pins is positioned to engage recesses that are formed in the narrow edge surface of the key;

g) with the step of forming pin-receiving holes in the cylinder and in the plug further being carried out such that the second and third planes extend in a non-aligned, non-coplanar manner from the center axis coaxially through the second and third rows of pin-receiving holes, respectively, with the second and third planes being inclined relative to the first plane at unequal first and second angles of inclination, respectively, with the first angle being chosen from a first set of angles that reside within a range of about 75 to about 105 degrees, with the second angle being chosen from a second set of angles that reside with a range of about 75 to about 105 degrees, with the angles that comprise the first set differing from each other by no less than about 5 degrees, with the angles that comprise the second set differing from each other by no less than about 5 degrees, and with at least one of the chosen first and second angles of inclination not being equal to either of 90 and 105 degrees; and, h) with the step of forming pin-receiving holes in the cylinder and in the plug further being carried out such that at least one of the first and second angles of each of the locks of the set differs from a corresponding one of the first and second angles of each of the other locks of the set by at least about 5 degrees to ensure that the wrong key will not operate the wrong lock.

29. A single lock formed in accordance with the method of claim 28 for use with a set of locks that also have been formed in accordance with said method.

30. A set of locks comprising at least one plug and cylinder lock formed in accordance with the method of claim 28.

31. A set of locks comprising a plurality of plug and cylinder locks formed in accordance with the method of claim 28.

32. The method of claim 28 wherein the step of forming pin-receiving holes in the cylinder and in the plug also is carried out such that at least one of the first and second sets of angles include about 75, about 80, about 85, about 90, about 95, about 100 and about 105 degrees.

33. The method of claim 28 wherein the step of forming pin-receiving holes in the cylinder and in the plug also is carried out such that at least one of the first and second sets of angles include about 78, about 83, about 88, about 93, about 98 and about 103 degrees.

34. The method of claim 28 wherein the step of forming pin-receiving holes in the cylinder and in the plug also is carried out such that at least one of the first and second sets of angles includes angles that differ from each other by no less than about 10 degrees.

35. The method of claim 28 wherein the step of forming pin-receiving holes in the cylinder and in the plug also is carried out such that at least one of the first and second sets of angles includes angles of about 80, about 90 and about 100 degrees.

36. The method of claim 28 wherein the step of forming pin-receiving holes in the cylinder and in the plug also is carried out such that at least one of the first and second sets of angles includes angles of about 83, about 93 and about 103 degrees.

37. The method of claim 28 wherein the step of forming pin-receiving holes in the cylinder and in the plug also is carried out such that at least one of the first and second sets of angles includes angles of about 75, about 85, about 95 and about 105 degrees.

38. The method of claim 28 wherein the step of forming pin-receiving holes in the cylinder and in the plug also is carried out such that at least one of the first and second sets of angles includes angles of about 78, about 88 and about 98 degrees.

39. The method of claim 28 wherein the step of forming pin-receiving holes in the cylinder and in the plug also is carried out such that the first set of angles includes angles of about 75, about 80, about 85, about 90, about 95, about 100 and about 105 degrees, and the second set of angles includes angles of about 75, about 80, about 85, about 90, about 95, about 100 and about 105 degrees.

40. The method of claim 28 wherein the step of forming pin-receiving holes in the cylinder and in the plug also is carried out such that the first set of angles includes angles of about 78, about 83, about 88, about 93, about 98 and about 103 degrees, and the second set of angles includes angles of about 75, about 80, about 85, about 90, about 95, about 100 and about 105 degrees.

41. The method of claim 28 wherein the step of forming pin-receiving holes in the cylinder and in the plug also is carried out such that the first angle of inclination is selected to be about 75 degrees, and the second angle of inclination is selected from a set of angles that includes about 80, about 85, about 90, about 95, about 100 and about 105 degrees.

42. The method of claim 28 wherein the step of forming pin-receiving holes in the cylinder and in the plug also is carried out such that the first angle of inclination is selected to be about 80 degrees, and the second angle of inclination is selected from a set of angles that includes about 75, about 85, about 90, about 95, about 100 and about 105 degrees.

43. The method of claim 28 wherein the step of forming pin-receiving holes in the cylinder and in the plug also is carried out such that the first angle of inclination is selected to be about 85 degrees, and the second angle of inclination is selected from a set of angles that includes about 75, about 80, about 90, about 95, about 100 and about 105 degrees.

44. The method of claim 28 wherein the step of forming pin-receiving holes in the cylinder and in the plug also is carried out such that the first angle of inclination is selected to be about 90 degrees, and the second angle of inclination is selected from a set of angles that includes about 75, about 80, about 85, about 95, about 100 and about 105 degrees.

45. The method of claim 28 wherein the step of forming pin-receiving holes in the cylinder and in the plug also is carried out such that the first angle of inclination is selected to be about 95 degrees, and the second angle of inclination is selected from a set of angles that includes about 75, about 80, about 85, about 90, about 100 and about 105 degrees.

46. The method of claim 28 wherein the step of forming pin-receiving holes in the cylinder and in the plug also is carried out such that the first angle of inclination is selected to be about 100 degrees, and the second angle of inclination is selected from a set of angles that includes about 75, about 80, about 85, about 90, about 95 and about 105 degrees.

47. The method of claim 28 wherein the step of forming pin-receiving holes in the cylinder and in the plug also is carried out such that the first angle of inclination is selected to be about 105 degrees, and the second angle of inclination is selected from a set of angles that includes about 75, about 80, about 85, about 90, about 95 and about 100 degrees.

48. The method of claim 28 wherein the step of forming pin-receiving holes in the cylinder and in the plug also is carried out such that neither of the first and second angles of inclination is equal to 90 degrees, and wherein neither of the first and second angles of inclination is equal to 105 degrees.

49. The method of claim 28 wherein the step of providing an elongate key that has recesses formed in two relatively flat, opposed side surfaces thereof is carried out such that all of the recesses that are formed in the two relatively flat, opposed side surfaces of the key are of generally oblong shape.

* * * * *